US005149037A

United States Patent [19]

Smith

[11] Patent Number: 5,149,037

[45] Date of Patent: Sep. 22, 1992

[54] WALL HANGER

[76] Inventor: Alan Smith, 31501 West St., Laguna Beach, Calif. 92677

[21] Appl. No.: 673,415

[22] Filed: Mar. 22, 1991

[51] Int. Cl.[5] ..... A47K 1/00

[52] U.S. Cl. ..... 248/216.1; 248/222.2; 248/903

[58] Field of Search ..... 248/216.1, 216.4, 217.1, 248/217.3, 222.2, 231.9, 475.1, 903

[56] References Cited

U.S. PATENT DOCUMENTS

| | | | |
|---|---|---|---|
| 3,312,442 | 4/1967 | Moeller | 248/216.1 |
| 3,476,344 | 11/1969 | Pace | 248/216.1 |
| 4,013,253 | 3/1977 | Perrault et al. | 248/903 X |
| 4,103,854 | 8/1978 | Pliml et al. | 248/222.2 |
| 4,485,995 | 12/1984 | Hogg | 248/222.2 X |
| 4,505,447 | 3/1985 | Shaheen | 248/216.1 |
| 4,619,430 | 10/1986 | Hogg | 248/216.1 X |
| 4,796,848 | 1/1989 | Lanz | 248/216.1 X |

FOREIGN PATENT DOCUMENTS

| | | | |
|---|---|---|---|
| 0225830 | 3/1925 | United Kingdom | 248/217.3 |

*Primary Examiner*—Ramon O. Ramirez

*Attorney, Agent, or Firm*—Plante, Strauss & Vanderburgh

[57] ABSTRACT

A wall hanger particularly adapted for supporting heavy objects includes as a base, a plate which defines a front and a rear face, the rear face being contiguous with the external surface of the wall when the device is installed. A hanger element extends from the front face of the plate and includes a supporting surface for an object to be carried by the device. An arcuate arm extends from the rear face of the plate and is adapted to be inserted through a hole in the wall. The free end of the arcuate arm is blunt so as to provide support for the device when the end of the arm contacts the rear surface of the wall member, but avoids any penetration of the rear surface of the wall member. In a preferred embodiment, the arcuate arm includes a flange which extends substantially the entire length of the arm and which extends downwardly to provide a reinforcing rib along the length of the arm. Preferably, the flange is notched adjacent the arm where it joins the rear face of the plate. The rear face of the plate may be provided with a cleat which is adapted to penetrate the wall member and which serves as a further aid in the prevention of the twisting of the device.

5 Claims, 1 Drawing Sheet

WALL HANGER

FIELD OF THE INVENTION

This invention relates to devices for hanging objects on a wall and, more particularly, to hangers for use with hollow wall construction.

BACKGROUND OF THE INVENTION

Securing an object on a wall can be a difficult problem, particularly when the object to be supported on the wall is heavy, such as a large portrait, a mirror or the like. This is due to the fact that most interior wall construction is of the hollow wall type, i.e., paneling or drywall construction, which is relatively thin and of low strength. Usually, with heavy objects such as mirrors and the like, it becomes necessary to locate wall studs in which to secure the hanger device. However, in many cases wall studs are hard to find or may even be formed of metal and thus not amenable to securing normal hanger devices. Alternatively, plastic or soft metal inserts may be inserted in pre-drilled holes in the wall to provide purchase for a screw or to act as a nut for a bolt. Such inserts can only be used once and they require a moderate amount of skill to correctly position in the wall, particularly when hanging very heavy objects. Various devices have been proposed to overcome the aforementioned problem and, generally, these devices include an arm adapted to be inserted through and into the space behind the wall. In some cases the arm is curved and the end of the arm formed into a point in order to contact and penetrate the rear surface of the wall to provide additional support. The opposite end of the devices include a hanger element which extends from the wall surface for supporting the object on the wall. Examples of these devices can be found in U.S. Pat. No. 4,619,430, Hogg, Oct. 28, 1986; No. 4,509,713, Hogg, Apr. 9, 1985; and No. 1,445, 372, Wagner, Feb. 13, 1923. These devices are not designed to support heavy loads, i.e. loads of as much as 50 pounds on hollow wall construction. In particular, when supporting a heavy object on hollow wall construction the reverse surface of the wall member can be penetrated to the point where sagging or deflection of the hanger device may occur can ultimately result in the loss of support for the object carried by the hanger element and damage to the wall itself.

SUMMARY OF THE INVENTION

It is an object of the present invention to provide an improved wall hanger for hollow wall construction which does not damage the rear surface of the wall once installed, and which provides improved support for objects.

Another object of the present invention is to provide an improved wall hanger for hollow wall construction which can be easily moved and reused.

Yet another object of the invention is to provide an improved wall hanger which is stable and not subject to twisting.

The foregoing objects and advantages as well as other features of the invention are achieved by the improved wall hanger of the present invention which is particularly adapted for supporting heavy objects and which includes as a base, a plate which defines a front and a rear face, the rear face being contiguous with the external surface of the wall when the device is installed. A hanger element extends from the front face of the plate and includes a supporting surface for an object to be carried by the device. An arcuate arm extends from the rear face of the plate and is adapted to be inserted through a hole in the wall. The free end of the arcuate arm is blunt so as to provide support for the device when the end of the arm contacts the rear surface of the wall member, but avoids any penetration of the rear surface of the wall member.

In a preferred embodiment, the arcuate arm includes a flange which extends substantially the entire length of the arm and which extends downwardly to provide a reinforcing rib along the length of the arm. Preferably, the flange is notched adjacent the arm where it joins the rear face of the plate.

In yet another embodiment of the invention, the rear face is also provided with a cleat which is adapted to penetrate the wall member and which serves as a further aid in the prevention of the twisting of the device.

The invention will be more readily understood from the following detailed description taken in conjunction with the drawings.

DETAILED DESCRIPTION OF THE INVENTION

Figure 1:
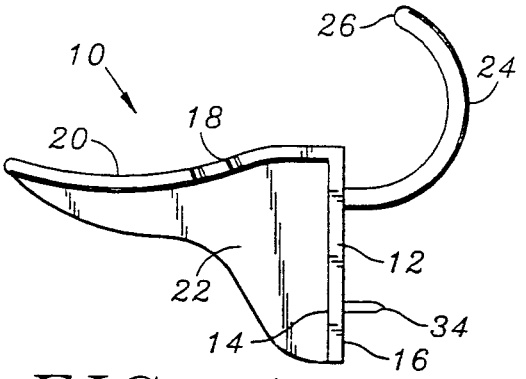
FIG. 1 is a side elevation of a hanger device in accordance with the invention.
Figure 2:
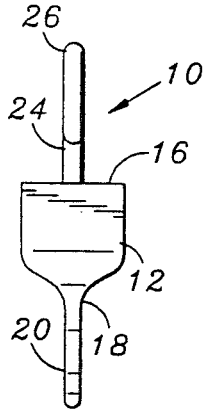
FIG. 2 is a top plan view of the device of FIG. 1.

Referring now to the drawings in which like characters and numerals designate like or corresponding parts throughout the several views, a wall hanger constructed in accordance with the invention is illustrated in FIGS. 1 and 2. Referring to FIGS. 1 and 2, the device 10 generally includes a plate 12 which defines a front face 14 and a rear face 16. The rear face 16 of the plate 12 is flat to be contiguous with the surface of a wall when the device 10 is properly installed. A hanger element 18 which includes a support area 20 extends perpendicularly from the front face 14 of the plate 12. Preferably, a bracing element such as a web 22 is provided to reinforce the hanger element 18. The particular design of the support area 20 of the hanger element 18 is not critical and may be specially designed for the support of specific objects, for example, the support area 20 may be hook shaped for supporting a mounting wire for pictures. As illustrated in FIG. 1, the support area 20 is relatively shallow and extends from the front face 14 for supporting larger objects such as tools, bicycles and the like.

Figure 3:
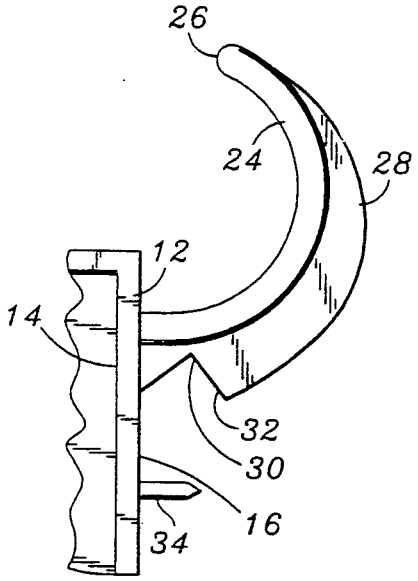
FIG. 3 is a side elevation of another embodiment of the invention.

An elongated arm 24 having a blunt free end 26 extends from the rear face 16 of the plate 12 and is generally curved or arcuate so that the arm 24 extends rearwardly upwardly and the free end 26 generally faces the rear surface of a wall member when the device 10 is installed. The free end 26 of the arm 24 is at least as wide as the arm 24 at its base and, if desired, may actually be wider so as to provide supporting contact at the rear surface of the wall member without penetrating the wall member. Preferably, as illustrated in FIG. 2, the arm 24 has a generally flattened rectangular cross section which is greater in one dimension than the other (as shown its width being greater than its height) so that, once inserted through a wall, the cross sectional configuration of the arm 24 aids in preventing the twisting or rotation of the device 10. As illustrated in FIG. 3, to a further prevent twisting of the device 10, a flange 28 extends from the lower and rear surfaces of the arm 24. The height of the flange 28 is greatest at the base of the arm 24 where it joins the rear face 16 of the plate 12 and gradually decreases in height toward the free end 26 of the arm 24 to further aid in defining the arcuate shape of the arm 24. The flange 28, adjacent the base of the arm 24, is provided with a notch 30 which defines a shoulder 32 which serves as a stop to prevent the device 10 from working loose and from pulling away from the wall when the device 10 is fully seated in the wall member, even after repeated loading on the device 10.

In the device 10 illustrated in FIGS. 1, 2 and 3, a cleat 34 extends perpendicularly from the rear face 16 of the plate 12. The cleat 34 is designed to penetrate the exterior surface of the wall and to further aid against twisting of the device 10.

Figure 4:
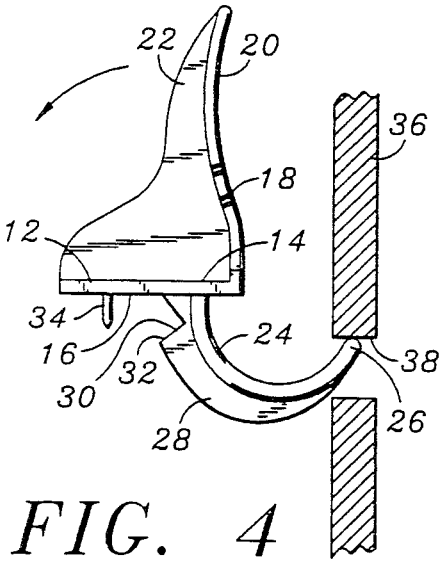
FIG. 4 illustrates the initial stage of mounting the device of FIG. 3 on a wall.
Figure 5:
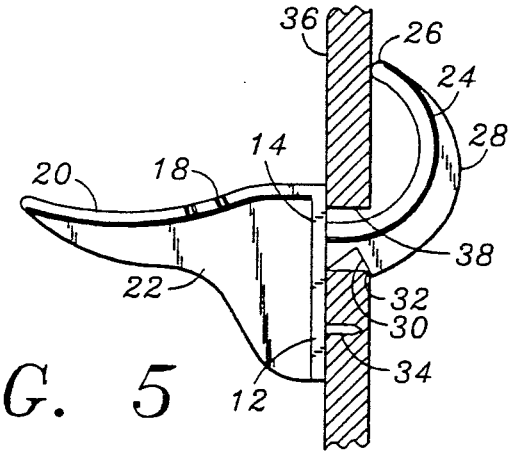
FIG. 5 shows the device of FIG. 3 in its final position locked in place on the wall.

The operation of the device 10 is illustrated in FIGS. 4 and 5. In operation, the device 10 is mounted on a wall member 36 by inserting the arcuate arm 24 through a suitably sized hole 38 which has been pre-formed in the wall member 36, such as by drilling or by driving a nail or the like. As is most clearly illustrated in FIG. 4, when the arcuate arm 24 is first inserted in the hole 38 in the wall member 36, the plate 12 and hanger element 18 of the device 10 are tilted in an upward position. The arcuate form of the arm 24 causes the device 10 to rotate until the rear face 16 of the plate 12 is contiguous with the surface of the wall member 36. The blunt end 26 of the arcuate arm 24 is then adjacent the inner surface of the wall member 36 and normally is in contact therewith to provide additional support for the device, as is shown in FIG. 5. The notch 30 and shoulder 32 define a seat in the in the flange 28 to receive a portion of the wall member 36 when the device 10 is fully seated in the wall 36. The shoulder 32 acts against the inner surface of the wall 36 to prevent the device 10 from pulling away from the wall 36. It will be understood, however, that the device 10 as illustrated in FIGS. 1 and 2 is effective without provision of the flange 28 or the notch 30 and shoulder 32. The device 10 is finally seated in its proper position on the wall member 36 by a slight downward tapping on the hanger element 18 which causes the cleat 34 to penetrate the surface of the wall member 36 to prevent twisting of the device 10 once it is seated.

The length of the arcuate arm 24 is primarily determined by the thickness of the wall member 36 for which the device 10 is designed to be used. That is to say, in order to ensure proper seating of the device 10 on the wall member 36 and to obtain maximum support from the blunt end 26 of the arcuate arm 24 against the rear face 16 of the plate 12, the vertical plane of the terminus of the arcuate arm 24 should be spaced from the vertical plane of the rear face 16 of the plate 12 a distance approximately equal to the thickness of the wall member 36 on which the device 10 is to be mounted. In this manner, when the device 10 is finally seated on the wall member, both the rear face 16 of the plate 12 and the blunt end 26 of the arcuate arm 24 are in contact with the exterior and interior surfaces of the wall member 36, respectively.

As will be understood by those skilled in the art, various arrangements other than those described in detail in the specification will occur to those persons skilled in the art, which arrangements lie within the spirit and scope of the invention. It is therefore to be understood that the invention is to be limited only by the claims appended hereto.

Having described the invention, I claim:

1. A device for supporting objects on a wall, said device comprising:

a. a base defining a front and a rear face, said rear face defining a supporting surface for contact with the exterior surface of said wall;

b. a hanger portion extending from said front face of said base, said hanger element including a support area for receiving and carrying a portion of said object being supported; and c. an elongate arcuate arm extending from said rear face of said base and adapted to extend through an aperture in the wall, said arcuate arm terminating in a blunt tip for non-penetrating contact with the interior surface of the wall, said arm having a rectangular cross section, a downwardly extending flange running the length of said elongate arm, the downward extension of the flange being greatest at the base of the arm where it joins said rear face of said base and gradually decreasing toward said free end of said arm.

2. The device of claim 1 wherein a cleat extends perpendicularly from said rear face of said base, said cleat being adapted to penetrate the exterior surface of said wall thereby to aid against twisting of the device.

3. The device of claim 1 wherein said blunt tip of said arcuate arm is at least as wide as said arm.

4. The device of claim 1 wherein said blunt tip of said arcuate arm is wider than said arm.

5. A device for supporting objects on a wall, said device comprising:

a. a base defining a front and a rear planar face, said rear face defining a supporting surface for contact with the exterior surface of said wall;

b. a hanger portion extending from said front face of said base, said hanger element including a support area for supporting and carrying a portion of said object being supported;

c. an elongate arcuate arm extending from said rear face of said base and adapted to extend through an aperture in the wall, said arcuate arm terminating in a blunt tip which is at least as wide as said arm for non-penetrating contact with the interior surface of the wall, said arm having a rectangular cross section, a downwardly extending flange running the length of said arm, the downward extension of the flange being greatest at the base of the arm where it joins said rear face of said base and gradually decreasing toward said blunt end of said arm, said flange being provided with a notch adjacent said rear face of said base, said notch defining a shoulder which acts against the inner surface of the wall to prevent said device from pulling away therefrom.

* * * * *